United States Patent [19]

Saxon et al.

[11] 4,395,804

[45] Aug. 2, 1983

[54] CHEEKPLATE HOLDER ASSEMBLY FOR STUFFER BOX CRIMPER

[75] Inventors: Daniel I. Saxon, Kingsport; Vernon L. Leonard, Bristol, both of Tenn.

[73] Assignee: Eastman Kodak Company, Rochester, N.Y.

[21] Appl. No.: 264,314

[22] Filed: May 18, 1981

[51] Int. Cl.[3] ..... D02G 1/12

[52] U.S. Cl. ..... 28/269; 28/264

[58] Field of Search ..... 28/263, 264, 268, 269, 28/270

[56] References Cited

U.S. PATENT DOCUMENTS

| | | | |
|---|---|---|---|
| 2,917,785 | 12/1959 | Gibson | 28/263 |
| 3,373,469 | 3/1968 | Boggs | 28/269 |
| 4,115,908 | 9/1978 | Saxon et al. | 28/269 |

FOREIGN PATENT DOCUMENTS

| | | | |
|---|---|---|---|
| 2329978 | 12/1974 | Fed. Rep. of Germany | 28/269 |
| 1205534 | 9/1970 | United Kingdom | 28/263 |

*Primary Examiner*—Robert Mackey

*Attorney, Agent, or Firm*—Malcolm G. Dunn; Daniel B. Reece, III

[57] ABSTRACT

A cheekplate holder assembly for use in a stuffer box crimper for continuous filament tow, with the cheekplate and its holder assembly as a unit being safely and readily removable from and reinsertable into the stuffer box crimper and the cheekplate movable into operative position against the endfaces of the feedrolls of the stuffer box crimper without stopping the rotation of the feedrolls.

9 Claims, 12 Drawing Figures

CHEEKPLATE HOLDER ASSEMBLY FOR STUFFER BOX CRIMPER

FIELD OF THE INVENTION

Our invention relates to stuffer box crimpers for crimping textile and industrial continuous filament tows, and particularly to a cheekplate holder assembly for holding a cheekplate, such as may be made from ceramic, brass or other suitable materials, against the endfaces of the feedrolls of a stuffer box crimper.

BACKGROUND OF THE INVENTION

Stuffer box crimping involves continuously feeding yarn or continuous filament tow through the nip of a pair of coacting feedrolls into a crimping chamber, which may or may not be heated and which has some type of arrangement for adjusting the back pressure upon the yarn or tow in the crimping chamber, such as a clapper gate arrangement.

Continuous filament tow, for example, is fed through the nip of the coacting feedrolls into the crimping chamber against the tow that is being held in the crimping chamber by the clapper gate arrangement. The incoming tow thus piles up against the chamber tow with the result that individual filaments become folded, convoluted and compressed. This continues until at some point in time, dependent upon feed rate, chamber geometry and the extent of back pressure, crimped tow is forced out the discharge opening of the crimping chamber by other incoming tow.

The continuous filament tow may be made from any of the man-made fibers, such as from cellulose esters, polyesters, polyamides and the like. Some tows have substances in them such as a pigment like titanium dioxide ($TiO_2$) which causes the tow to have an abrasive wearing effect on the crimping chamber, especially with side structures which abut the endfaces of the nip or feedrolls for the purpose of confining the tow to the nip of the rolls as the tow passes into the crimping chamber. These side structures can become so worn as to cause poorly formed edges on the tow passing through the crimping chamber and even tearing and breaking of the filaments that come into contact with the worn side structures.

These side structures may take a variety of different forms. U.S. Pat. No. 3,249,979 discloses a stuffer box crimper that has replaceable disc inserts which bear against the outer faces of the rotating rolls of the stuffer box. U.S. Pat. No. 3,120,692 discloses plates 3*a*,3*b* that serve as such side structures and are of a different configuration than the aforementioned discs. The design of some discs or plates is such that the disc or plate may be removed and turned around so as to present a fresh surface to the endfaces of the coacting feedrolls when the initial surface of the disc or plate starts to show wear.

In many cases, the design or placement of the stuffer box crimper is such that it is necessary to shut the stuffer box crimper down before the operator can safely remove the discs or plates and reinsert and/or replace with new ones without causing injury to the operator and/or damage to the stuffer box crimper and to the disc or plate the operator is attempting to reinsert.

If a stuffer box crimper has to be shut down to change or replace the side plates or discs, then normally this may mean one of several things: (1) if the tow is coming directly from spinning cabinets, then the spinning cabinets upstream of the stuffer box crimper must either be stopped or the tow must be allowed to go to waste; or (2) if the tow is coming from containers or tubs then it is only necessary to stop the stuffer box crimper and any necessary equipment upstream between the stuffer box crimper and the containers or tubs.

An object of the invention, therefore, is to provide an arrangement by which a side structure called a "cheekplate" may be safely removed, reinserted and adjusted relative to the endfaces of the coacting feedrolls of a stuffer box crimper while the feedrolls are still rotating; i.e., without having to stop the operation of the stuffer box crimper or any of the other operating equipment upstream of the stuffer box crimper.

DISCLOSURE OF INVENTION

In accordance with the present invention, we provide an improved apparatus structure in an apparatus for crimping continuous filament tow, with the apparatus having a stuffer box crimping chamber having a suitable arrangement for restricting the passage of crimped filament tow from the crimping chamber; a pair of coacting feedrolls spaced closely together so as to form therebetween a nip through which moving continuous filament tow is fed into the stuffer box crimping chamber; a pair of scraper blades extending longitudinally generally parallel to and at right angles to the axes of the coacting feedrolls and forming two opposed sides of the crimping chamber, each scraper blade having a blade edge positioned so that it nearly touches one of the feedroll surfaces; and sidewall structures extending along the length of each side of the stuffer box crimping chamber and also along and adjacent the endfaces of the coacting feedrolls and the side edges of the pair of scraper blades.

Each of the sidewall structures include a cheekplate that is adapted to bridge the nip of the endfaces of the coacting feedrolls when in abutment against the endfaces to form a sealing relation therewith, and a cheekplate holder assembly for supporting the cheekplate. The cheekplate holder assembly includes (a) a retainer member having along one side a pair of parallel rail members and therebetween a flat surface along which the cheekplate is slidably positioned; and (b) an arrangement for retaining the cheekplate in a predetermined adjusted position along the flat surface and relative to the endfaces of the coacting feedrolls. The sidewall structures also include an adjustment arrangement for applying pressure against the side of the retainer member opposite from the cheekplate for moving the cheekplate holder assembly and the supported cheekplate toward the feedroll endfaces so as to urge the cheekplate into abutment against the feedroll endfaces. The parallel rail members are also parallel to the sidewall structures and to the endfaces of the coacting feedrolls.

The sidewall structures further include along one side thereof a pair of parallel guide rails and therebetween a planar surface along which the cheekplate holder assembly is moved into and out of the sidewall structures by sliding engagement of the parallel rail members of the retainer member with the parallel guide rails of the sidewall structure.

The parallel rail members of the retainer member have structural arrangements for engaging the pair of parallel guide rails and for holding the cheekplate out of contact with the feedrolls when the cheekplate holder assembly is being moved into and out of the sidewall structures. The pair of parallel guide rails are also parallel to the sidewall structures and to the endfaces of the coacting feedrolls.

The parallel guide rails of the sidewall structures each define flanged slide surfaces for slidably retaining the retainer member therewithin, and the retainer member has a shoulder abutment arrangement adapted to interlockingly abut with one end of one of the parallel guide rails when the adjustment arrangement moves the cheekplate holder assembly into abutment against the feedroll endfaces.

The parallel guide rails of the sidewall structures and the planar surface which lies between the parallel guide rails on the one hand and the parallel rail members of the retainer member and the aforementioned side opposite of the retainer member on the other hand are spaced a predetermined distance apart to enable the retainer member and the cheekplate to be rocked in any plane for self-alignment of the cheekplate with respect to the feedroll endfaces.

Each pair of parallel guide rails of the sidewall structures each define flanged slide means having outer and inner slide surfaces parallel to the planar surface lying between the parallel guide rails and an opposed side sliding surface adjacent to and at right angles to the inner slide surface and to the aforementioned parallel surface. The pair of parallel rail members of the retainer member each defines slide surfaces having upper and side slide surfaces adapted to slidably engage, respectively, the inner and opposed sliding surfaces of the parallel guide rails of the sidewall structures.

The arrangement for retaining the cheekplate in a predetermined adjusted position along the flat surface between the parallel rail members of the retainer member includes a tow shield member that is adjustably connected to the retainer member. The tow shield member is adapted on one side to overlie in part one end of the cheekplate to hold it against the flat surface of the retainer member, and defines upon the opposite side from the cheekplate a flat guide surface for guiding therealong tow into the nip of the feedrolls. The tow shield member also defines at its forward end relative to the travel of tow through the crimper two concave arcuate edges, each arcuate edge being concentric with one of the feedrolls and is adapted to be positioned close to but not touching with the feedroll surfaces.

The sidewall structures further include a fixed wall surface on each side and extending forward of the cheekplate holder assembly and along which the continuous filament tow is guided along the crimping chamber.

The adjustment arrangement for applying pressure against the side of the retainer member involves a bullet that has a dome-like surface adapted to engage the side of the retainer member opposite from the cheekplate and has at its opposite end a beveled surface. The bullet is slidably movable in a plane at right angles to the retainer member. The adjustment arrangement also involves a wedge-like structure that is movable in a plane into engaging line contact with and out of line contact with the beveled surface of the bullet so as to apply pressure against and move the bullet or release pressure therefrom.

Another adjustment arrangement is also provided for adjusting the position of engagement of the dome-like surface of the bullet along the length of the retainer member.

BRIEF DESCRIPTION OF DRAWINGS

The details of our invention will be described in connection with the accompanying drawings, in which.

BEST MODE FOR CARRYING OUT THE INVENTION

Figure 1:
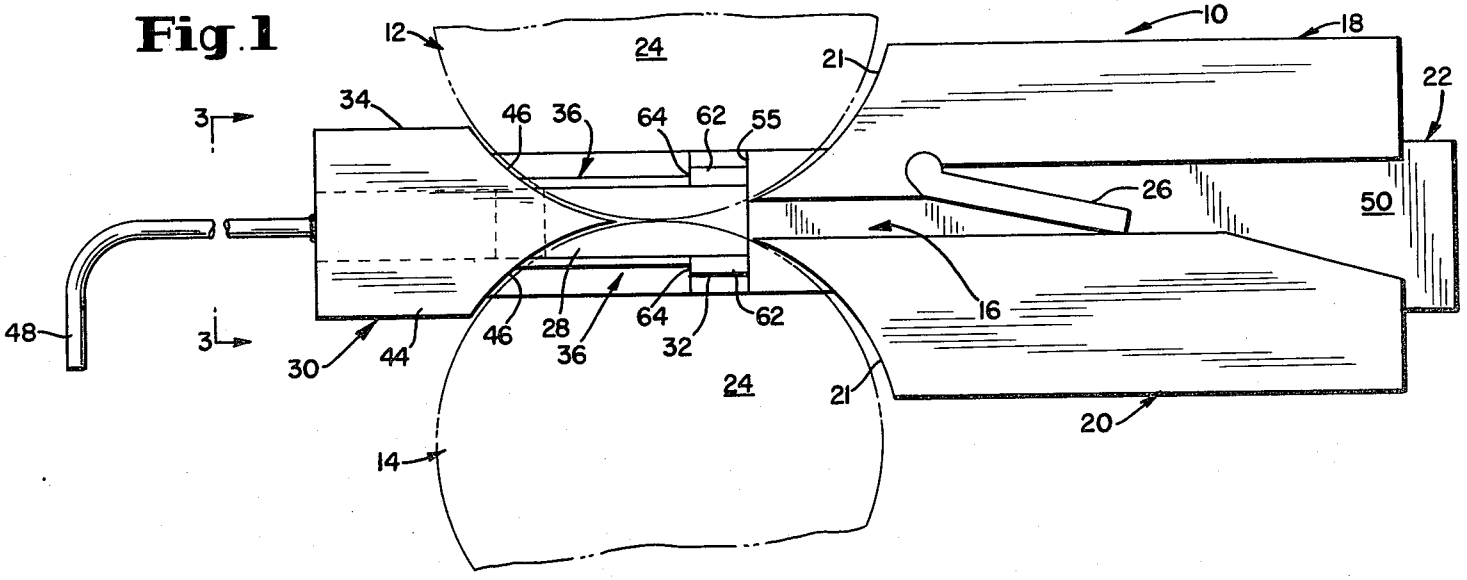
FIG. 1 is an elevational view illustrating the feedrolls in phantom line, and upper and lower scraper blades of a stuffer box crimper, and shows in part the cheekplate holder assembly of the invention.

In reference to the drawings, FIG. 1 shows one type of stuffer box crimping apparatus 10 of the prior art in which the invention may be used. The apparatus has a pair of coacting upper and lower feedrolls 12,14, respectively, spaced closely together so as to form a nip therebetween through which moving continuous filament tow (not shown) is fed (from left to right, as viewed from FIG. 1) into a stuffer box crimping chamber 16. A pair of upper and lower scraper blades 18,20, respectively, extend from the feedrolls in a longitudinal direction and are generally parallel to and at right angles to the axis of rotation of the feedrolls 12,14. The scraper blades form two opposed sides of the crimping chamber 16. Each scraper blade edge 21 is positioned so that it nearly touches one of the feedroll surfaces. It is essential that the blade edges do not actually touch the feedroll surfaces so that the feedroll surfaces will not be galled by the blade edges or otherwise damaged. The near-touching position of the scraper blades serves to minimize the possibility of any fiber becoming adhered to the feedroll surfaces and escaping from the crimping chamber before the exit end of the crimping chamber.

A pair of sidewalls or sidewall structures 22 (only one such sidewall or sidewall structure is shown in FIG. 1) extend along the length of the stuffer box crimping chamber 16 and also along and adjacent in parallel relation to the endfaces 24 of the coacting feedrolls, and also along and in parallel relation to the side edges of the scraper blades 18,20.

A clapper gate or door is usually provided at or near the exit end of the crimping chamber of a stuffer box apparatus, and serves to adjustably restrict the passage of fibers or tow from the crimping chamber. The clapper gate thus provides one form of arrangement by which the back pressure may be adjusted in the crimping chamber. The design of a clapper gate is quite varied in the industry, and in one form it may be hinged to one of the scraper blades as shown by the clapper gate 26 in FIG. 1, and it may also be integral with one of the scraper blades, as shown in FIG. 1 of U.S. Pat. No. 4,115,908, thus forming a hingeless clapper gate. The adjustment of the clapper gate may be accomplished in a number of ways well known in the art.

Each sidewall or sidewall structure 22 includes a cheekplate 28 that is adapted to bridge the nip of the endfaces of the coacting feedrolls 12,14 when the cheekplate is in abutment against the endfaces. The cheekplate may be made of any suitable wear-resistant material such as brass or ceramic, preferably ceramic, and in the instant application is shown as having the configuration of a rectangular solid. The cheekplate is supported in the sidewall or sidewall structure in such manner that it can be readily removed for reversal of its abutting face or complete replacement without stopping the operation of the stuffer box crimper and thus without risk of injury to the operator or damage to the feedrolls or to the cheekplate. In the past, of course, it has been necessary to stop the operation of a stuffer box crimper before the cheekplate could be changed. If an operator attempted to install a new cheekplate while the crimper was still operating, i.e., while the feedrolls were still rotating, the feedrolls would tend to grab the cheekplate and pull it into the nip. This would cause the cheekplate to shatter, if made from ceramic-like materials, and thus endanger nearby personnel with a shower of pieces as well as cause damage to the feedrolls.

a. Cheekplate Holder Assembly

The cheekplate 28 is thus adjustably held in the sidewall or sidewall structure 22 on each side of the feedrolls by a cheeekplate holder assembly 30, which not only supports and holds the cheekplate but is also slidably removable with the cheekplate as a unit from the stuffer box crimper and is slidably reinsertable with the cheekplate as a unit into the stuffer box crimper. The sidewall or sidewall structure 22 and the cheekplate holder assembly 30 have cooperating structures that enable the cheekplate holder assembly and its supported cheekplate to be safely guided from the stuffer box crimper and in return to the stuffer box crimper, and also for physical movement of the cheekplate away from its operative position in abutment with the endfaces of the feedrolls and in return to such operative position.

The cheekplate holder assembly 30 includes a retainer member 32, and a tow shield member 34. The retainer member 32 is an elongated member having along one side a pair of parallel rail members 36 and between the rail members a flat surface 38 along which the cheekplate 30 is slidably positioned. The parallel rail members each have an upper slide surface 40 and a side slide surface 42. The parallel rail members 36 are also parallel to the sidewall structures 22 and to the endfaces of the coacting feedrolls 12,14.

Figure 2:
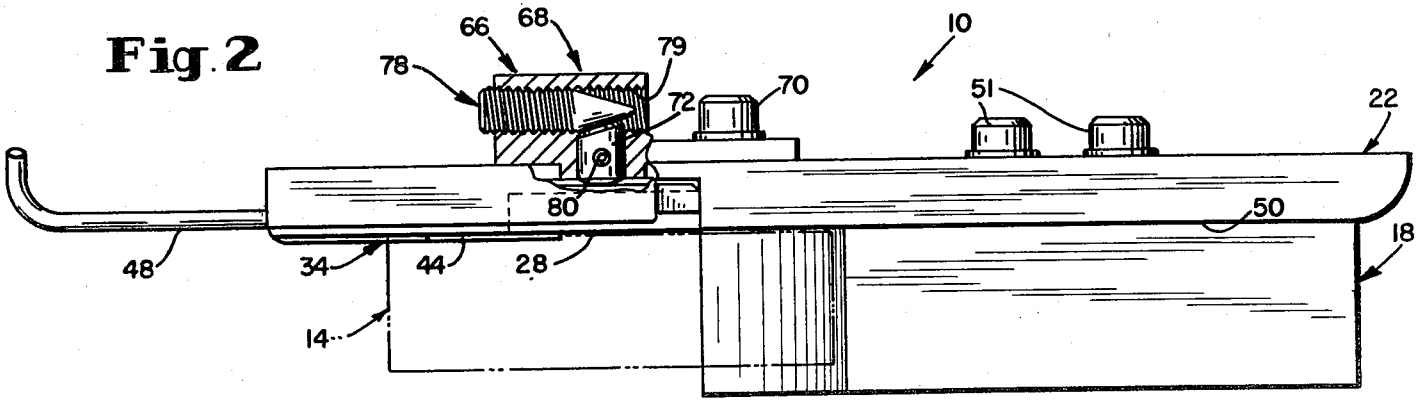
FIG. 2 is a partial plan view of the stuffer box crimper partly in cross-section and illustrating the adjustment device for the cheekplate holder assembly as well as a portion of the cheekplate.
Figure 5:
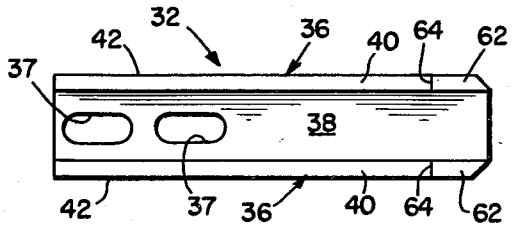
FIG. 5 is an elevational view of the retainer member by itself.
Figure 6:
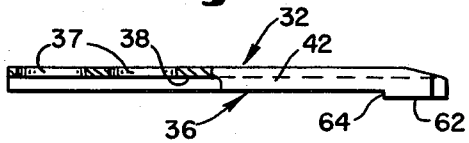
FIG. 6 is a plan view partially broken away of the retainer member by itself.
Figure 4:
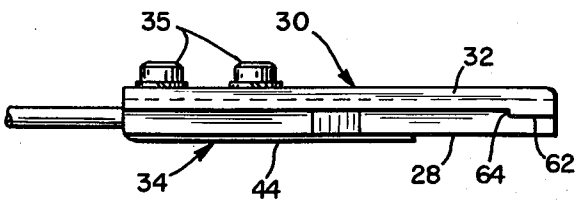
FIG. 4 is a plan view of the cheekplate holder assembly and the cheekplate, with a portion of the handle broken away.
Figure 3:
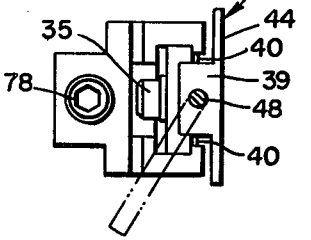
FIG. 3 is an end view of the cheekplate holder assembly taken along line 3—3 in FIG. 1.
Figure 9:
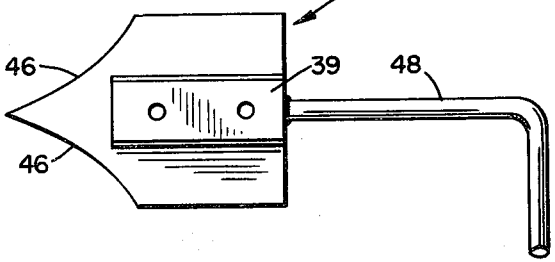
FIG. 9 is an elevational view of the tow shield member by itself.

The tow shield member 34 is adjustably connected to the retainer member 32 by bolts 35 through elongated slots 37 in the retainer member, and is adapted on one side to overlie in part one end of the cheekplate so as to hold the cheekplate against the flat surface 38 of the retainer member, as may be seen from FIGS. 1 and 2. The extent to which the tow shield member overlies the cheekplate may be adjusted upon loosening bolts 35 and sliding the tow shield member relative to the retainer member and the cheekplate, and then retightening bolts 35. One side of the tow shield member has a raised portion 39 (note also FIG. 3 and FIG. 9) which is essentially the same width as the cheekplate 28 and as the flat surface 38 between the parallel rail members 36. The raised portion 39 thus fits slidingly between the parallel rail members as shown in FIG. 3, and serves to center the tow shield member with respect to the nip between the feedrolls. The opposite side of the tow shield member has a flat guide surface 44 that serves to guide tow into the nip of the feedrolls. The tow shield member has at its forward end relative to the travel of tow through the crimper two concave arcuate edges 46, each of which is concentric with one of the feedrolls and is adapted to be positioned close to but not touching with the feedroll surfaces. A handle 48 is suitably connected to the tow shield member, as by welding, by which the cheekplate holder assembly 30 may be removed and reinserted by the operator.

b. Sidewall or Sidewall Structure

The sidewall or sidewall structure 22 on each side of the feedrolls may be either an integral member or may be formed in two parts with a fixed wall surface 50 extending forward of the cheekplate holder assembly in the stuffer box crimper and along which continuous filament tow is guided along the crimping chamber. The lower scraper blade 20 may be connected to the sidewall 22 by bolts 51 through slots 53 in the sidewall 22.

Figure 7:
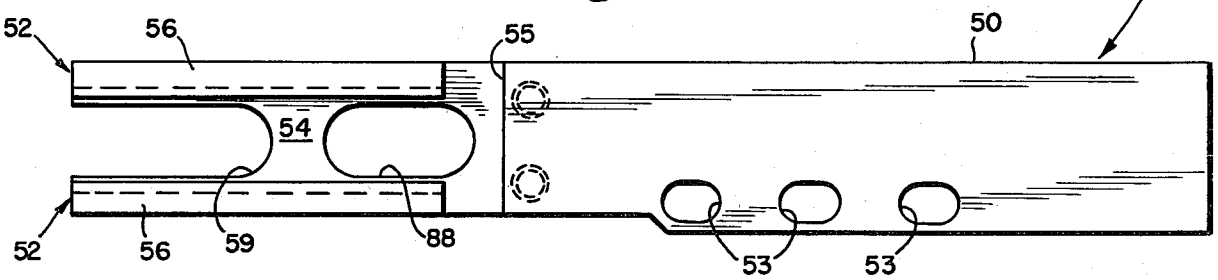
FIG. 7 is an elevational view of the sidewall or sidewall structure of the stuffer box crimper.
Figure 8:
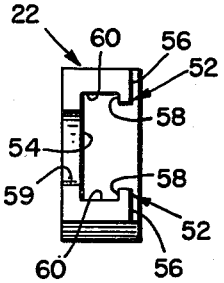
FIG. 8 is an end view of the sidewall or sidewall structure of the stuffer box crimper.

Each sidewall or sidewall structure 22 has along one side thereof a pair of parallel guide rails 52 (note also FIGS. 7 and 8) and between the guide rails a planar surface 54 along which the cheekplate holder assembly 30 is moved into and out of the sidewall or sidewall structure by sliding engagement of the parallel rail members 36 of the retainer member 32 with the parallel guide rails 52 of the sidewall or sidewall structure 22. The parallel guide rails are also parallel to the sidewall structures 22.

The parallel guide rails 52 are essentially parallel to the endfaces 24 of the feedrolls 12,14 and extend from upstream of the nip of the feedrolls to just past the nip and terminate at a predetermined distance spaced from the beginning of the fixed wall surface 50 to define therewith and therebetween a gap 55 for a purpose that will be described later.

The pair of parallel guide rails 52 of the sidewall each has a flanged slide surface for slidably retaining the retainer member therewithin. The flanged slide surfaces include an outer slide surface 56 and an inner slide surface 58, which are parallel to the planar surface 54, and an opposed side sliding surface 60, which is adjacent to and at right angles to the inner slide surface 58 and to the planar surface 54. (Note also FIGS. 3, 5, 6, 7 and 8.)

The aforementioned upper slide surfaces 40 and side slide surfaces 42 of the parallel rail members 36 are thus adapted to slidably engage, respectively, the inner slide surfaces 58 and opposed side sliding surfaces 60 of the parallel guide rails 52 of the sidewall or sidewall structure 22.

The parallel rail members 36 of the retainer member 32 each have raised surfaces 62, each of which defines at one end a shoulder abutment 64. The shoulder abutments are adapted to interlockingly abut with one end of one of parallel guide rails 52 of the sidewall or sidewall structure 22 when the cheekplate holder assembly is in operative position with the cheekplate 28 in abutment against the endfaces 24 of the feedrolls 12,14. When the cheekplate holder assembly is being withdrawn from or being reinserted into the stuffer box crimper apparatus, the raised surfaces 62 on the parallel rail members 36 will engage the inner slide surfaces 58 of the parallel guide rails 52 and thus hold the cheekplate out of contact with the feedrolls. The sidewall or sidewall structure 22 is further provided with an open-ended elongated slot 59 (FIG. 6), which allows the two bolts 35 on the tow shield member 34 to clear the sidewall (note FIG. 3).

c. Adjustment of Cheekplate

Figure 10:
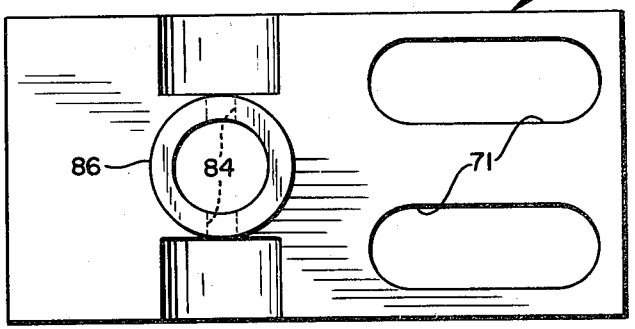
FIG. 10 is an elevational view of the housing for the adjustment device.
Figure 11:
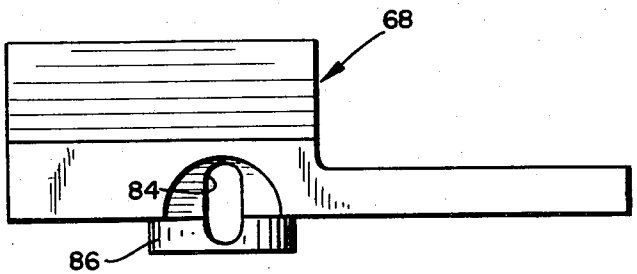
FIG. 11 is a plan view of the housing for the bullet device.
Figure 12:
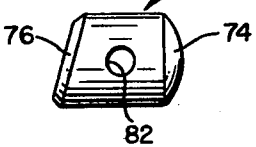
FIG. 12 is an elevational view of the bullet by itself.

Each sidewall or sidewall structure 22 includes an adjustment device 66 for applying pressure against the side of the retainer member 32 opposite from the cheekplate 28 for moving the cheekplate holder assembly and the supported cheekplate toward the feedroll endfaces 24 so as to urge the cheekplate into abutment against the feedroll endfaces. The adjustment device includes a housing 68 (see also FIGS. 10 and 11) that is slidably and adjustably connected to the opposite side of the sidewall or sidewall structure 22 by bolts 70 (only one illustrated in FIG. 2) through elongated slots 71 in the housing; a reciprocably slidable bullet 72 (see also FIG. 12) having at one end a dome-like surface 74 and at the other end a beveled surface 76; and a wedge member or cone-point screw 78 being threaded at one end and adapted to move in bore 79 (FIG. 2) in a plane into engaging line contact with and out of line contact with the beveled surface 76 of the bullet 72. This contact results in the dome-like surface of the bullet being urged against the side of the retainer member 32 opposite from the cheekplate 28, thereby causing the cheekplate in turn to be moved into abutment against the feedroll endfaces 24 in sealing relation therewith. The beveled surface 76 of the bullet is kept in proper orientation for line contact with the wedge member or cone-point screw 78 by means of a roll pin 80, which extends through a bore 82 formed through the bullet and rides at its opposite ends in mating slots 84 formed diametrically through the circular boss 86 of the housing 68. The roll pin 80 is expandable to form a frictional fit with the bore 82 in the bullet, but forms a loose fit with the greater dimensional mating slots so that the bullet may be readily reciprocably slidable.

As heretofore mentioned, the housing 68 is slidably adjustable relative to the sidewall or sidewall structure 22 so as to adjust the position of engagement of the dome-like surface 74 of the bullet 72 along the length of the retainer member 32. The purpose of such adjustment is to balance the force applied against the cheekplate so as to maintain proper sealing relation of the cheekplate with the feedroll endfaces 24. The circular boss 86 projects through the elongated slot 88 (FIG. 7) in the sidewall or sidewall structure 22. The extent to which the bullet may be adjusted is limited by the extent the circular boss may slide back and forth in the elongated slot 88.

d. Operation

Assuming that the cheekplate 28 is in abutment against the feedroll endfaces 24 and the operator wishes to remove the cheekplate for inspection, removal or replacement, the operator first reduces the clapper gate pressure; second reduces the pressure between the feedrolls; and third uses a doffing stick or other guiding arrangement to urge the edge of the continuous tow nearest the cheekplate to be changed away from the feedroll endfaces. The operator then backs off the bullet by turning the wedge member or cone-point screw 78, which is moved out of line contact with the beveled surface 76 of the bullet. The base of the cone-point screw may be designed to accommodate a hex-socket or slotted screw, with which an appropriate tool may be used, such as a Bondhus Balldriver, a product of the Bondhus Corporation in Monticello, Minnesota. The operator then grasps the handle 48 of the tow shield member 34 and rocks the retainer member 32 and its shoulder abutments 64 out of engagement with the one end of the parallel guide rails 52 of the sidewall or sidewall structure 22, and then withdraws the cheekplate holder assembly 30 from the stuffer box crimper 10. The raised surfaces 62 on the parallel rail members 36 ride or slide against the inner slide surface 58 of the parallel guide rails 52 of the sidewall 22 and in this manner hold the cheekplate 28 out of contact with the feedroll endfaces 24.

Upon reinsertion of the cheekplate holder assembly 30, the raised surfaces 62 on the parallel rail members again serve to hold the cheekplate 28 out of contact with the feedroll endfaces until the raised surfaces move into alignment with the gap 55, which is located between the parallel guide rails 52 and the beginning of fixed sidewall surface 50. The operator then rocks the cheekplate holder assembly until the shoulder abutments 64 are once more in engagement with one end of the parallel guide rails 52. The operator then turns the threaded wedge member or cone-point screw 78 until line contact is made with the beveled surface 76 on the bullet 72 for subsequent urging of the dome-like surface 74 into engagement with the retainer member 32.

The parallel guide rails 52 and the planar surface 54 on the one hand and the parallel rail members 36 and the side opposite of the retainer member on the other hand are spaced a predetermined distance apart to enable the retainer member and the cheekplate 28 to be rocked in any plane for self-alignment of the cheekplate with respect to the feedroll endfaces 24. In this manner, the cheekplate is caused to form a good sealing relation with the feedroll endfaces 24. When the operator tightens the wedge member 78, the cheekplate is then locked into an adjusted abutment position against the feedrolls.

The invention has been described in detail with particular reference to preferred embodiments thereof, but it will be understood that variations and modifications can be effected within the spirit and scope of the invention.

We claim:

1. In an apparatus for crimping continuous filament tow, said apparatus having a stuffer box crimping chamber having means for restricting the passage of crimped filament tow from said crimping chamber;

a pair of coacting feedrolls spaced closely together so as to form therebetween a nip through which moving continuous filament tow is fed into the stuffer box crimping chamber;

a pair of scraper blades extending longitudinally generally parallel to and at right angles to the axes of the coacting feedrolls and forming two opposed sides of the crimping chamber, each scraper blade having a blade edge positioned so that it nearly touches one of the feedroll surfaces; and sidewall means extending along the length of each side of the stuffer box crimping chamber and also along and adjacent the endfaces of the coacting feedrolls and the side edges of the pair of scraper blades; the improvement comprising:

said sidewall means including a cheekplate adapted to bridge the nip of the endfaces of the coacting feedrolls when in abutment against said endfaces to form a scaling relation therewith and a cheekplate holder assembly for supporting said cheekplate:

said cheekplate holder assembly including (a) a retainer member having along one side a pair of parallel rail members and therebetween a flat surface along which said cheekplate is slidably positioned, said parallel rail members also being parallel to said sidewall means and to the endfaces of the coacting feedrolls, and (b) means for retaining said cheekplate in a predetermined adjusted position along said flat surface and relative to said endfaces of the coacting feedrolls;

said sidewall means also including adjustment means for applying pressure against the side of said retainer member opposite from the cheekplate for moving said cheekplate holder assembly and the supported cheekplate towards said feedroll endfaces so as to urge said cheekplate into said abutment against the feedroll endfaces, and further including along one side thereof a pair of parallel guide rails parallel to said sidewall means and to the endfaces of the coacting feedrolls and having therebetween a planar surface along which said cheekplate holder assembly is moved into and out of said sidewall means by sliding engagement of said retainer member with said parallel guide rails of said sidewall means.

2. In an apparatus as defined in claim 1, wherein said parallel rail members of said retainer member have at one end thereof raised surface means adapted to be moved into engagement with said pair of parallel guide rails to hold said cheekplate out of contact with said feedrolls when said cheekplate holder assembly is being moved into and out of said sidewall means.

3. In an apparatus as defined in claim 1, wherein said pair of parallel guide rails of said sidewall means each defines flanged slide means for slidably retaining said retainer member therewithin, and said retainer member has shoulder abutment means adapted to interlockingly abut with one end of one of said parallel guide rails when said adjustment means moves said cheekplate holder assembly into said abutment against said feedroll endfaces.

4. In an apparatus as defined in claim 1, wherein said parallel guide rails and said planar surface therebetween on the one hand and said parallel rail members and said side opposite of the retainer member on the other hand are spaced a predetermined distance apart to enable said retainer member and the cheekplate to be rocked in any plane for self-alignment of the cheekplate with respect to said feedroll endfaces.

5. In an apparatus as defined in claim 1, wherein (a) said pair of parallel guide rails of said side wall means each define flanged slide means having outer and inner slide surfaces parallel to said planar surface and an opposed side sliding surface adjacent to and at right angles to said inner slide surface and to said planar surface; and (b) said pair of parallel rail members of said retainer member each defines slide means having upper and side slide surfaces adapted to slidably engage, respectively, said inner and opposed side sliding surfaces of the parallel guide rails of said sidewall means.

6. In an apparatus as defined in claim 5, wherein said means for retaining said cheekplate in a predetermined adjusted position along said flat surface of the retainer member includes a tow shield member adjustably connected to said retainer member and adapted on one side to overlie in part one end of said cheekplate to hold it against said flat surface of the retainer member, and defines upon the opposite side from said cheekplate a flat guide surface for guiding therealong tow into the nip of the feedrolls, and also defining at its forward end relative to the travel of tow through the crimper two concave arcuate edges, each arcuate edge being concentric with one of said feedrolls and adapted to be positioned close to but not touching with the feedroll surfaces.

7. In an apparatus as defined in claim 1, wherein said sidewall means further includes a fixed wall surface extending forward of said cheekplate holder assembly and along which said continuous filament tow is guided along said crimping chamber.

8. In an apparatus as defined in claim 1, wherein said adjustment means for applying pressure against the side of said retainer member comprises (a) bullet means slidably movable in a plane at right angles to said retainer member, said bullet means having at one end a dome-like surface adapted to engage said side of the retainer member opposite from the cheekplate, and having at its opposite end a beveled surface; and (b) wedge means movable in a plane into engaging line contact with and out of said line contact with said beveled surface so as to apply pressure against and move said bullet means or release pressure from said bullet means.

9. In an apparatus as defined in claim 8, wherein means is provided for adjusting the position of engagement of said dome-like surface of the bullet means along the length of said retainer member.

* * * * *